US007797976B2

(12) United States Patent
Friese

(10) Patent No.: US 7,797,976 B2
(45) Date of Patent: Sep. 21, 2010

(54) METHOD FOR THE PRODUCTION OF A FLANGE ON A METAL BLANK, AND TRANSMISSION PART

(75) Inventor: Udo Friese, Ahlen (DE)

(73) Assignee: WF-Maschinenbau und Blechformtechnik GmbH & Co. KG, Sendenhorst (DE)

( * ) Notice: Subject to any disclaimer, the term of this patent is extended or adjusted under 35 U.S.C. 154(b) by 688 days.

(21) Appl. No.: 10/579,727

(22) PCT Filed: Nov. 15, 2004

(86) PCT No.: PCT/EP2004/012924

§ 371 (c)(1),
(2), (4) Date: Mar. 21, 2007

(87) PCT Pub. No.: WO2005/046901

PCT Pub. Date: May 26, 2005

(65) Prior Publication Data

US 2007/0256465 A1 Nov. 8, 2007

(30) Foreign Application Priority Data

Nov. 17, 2003 (DE) ..... 103 53 750
Dec. 16, 2003 (DE) ..... 103 58 844

(51) Int. Cl.
*B21C 37/29* (2006.01)

(52) U.S. Cl. ..... 72/71; 72/83

(58) Field of Classification Search ..... 72/68, 72/70, 71, 82, 83, 84, 85, 110, 91, 92
See application file for complete search history.

(56) References Cited

U.S. PATENT DOCUMENTS

| | | | | |
|---|---|---|---|---|
| 5,619,879 | A | 4/1997 | Friese | |
| 5,806,358 | A * | 9/1998 | Rolf | 72/68 |
| 5,947,853 | A * | 9/1999 | Hodjat et al. | 474/166 |
| 5,987,952 | A * | 11/1999 | Kutzscher et al. | 72/71 |
| 6,484,401 | B1 | 11/2002 | Specht | |
| 6,484,547 | B1 * | 11/2002 | Kanemitsu et al. | 72/71 |
| 6,598,443 | B2 * | 7/2003 | Rose et al. | 72/71 |
| 6,688,149 | B2 * | 2/2004 | Friese | 72/71 |

FOREIGN PATENT DOCUMENTS

| | | | |
|---|---|---|---|
| DE | 44 00 257 | C1 | 12/1994 |
| DE | 44 44 526 | C1 | 11/1995 |
| DE | 100 33 239 | A1 | 1/2002 |
| DE | 101 60 038 | C1 | 3/2003 |
| JP | 2000-153312 | A | 6/2000 |

* cited by examiner

*Primary Examiner*—Edward Tolan
(74) *Attorney, Agent, or Firm*—Barnes & Thornburg LLP

(57) ABSTRACT

A method of forming a flange on a circular metal blank (1) has the following steps:

By means of at least one pressure roller (3), a hub-type and/or conical structure is formed on the circular metal blank, and from the conical structure (4), a flange (7) is formed on the circular metal blank (1) by means of a subsequent treatment.

30 Claims, 2 Drawing Sheets

METHOD FOR THE PRODUCTION OF A FLANGE ON A METAL BLANK, AND TRANSMISSION PART

BACKGROUND AND SUMMARY

The present disclosure relates to a method for the production or construction of a flange on a circular metal blank by one or more pressure rollers rotating relative to the circular metal blank, and to a transmission part having such a flange.

From German Patent Document DE 44 00 257 C1, as well as the parallel members of the patent family, among others, the European, U.S. and Japanese patent documents, it is known to construct a hub on a circular metal blank in a non-cutting manner. That is, a metal sheet bar or blank is carried by a tool of a main spindle and rotating relative to one or more pressure rollers. Pressure is first applied slightly axially and then, after the sinking into the circular blank, applied radially. The blank is reduced in its thickness by pressing by the pressure roller and is shaped into a cylindrical projection protruding from the metal sheet bar, which projection penetrates the circular metal blank. This method is reliable and cost-effective and has had good results in practice. It is particularly suitable for producing hubs which project axially relatively high from the surface of the circular metal blank facing the hub. The circular metal blank is held on its outer circumference by clamping chucks.

From German Patent Document DE 44 44 526, it is known that the circular metal blank is not held by clamping chucks but by an abutment chuck which has a ring-shaped construction and a slightly larger inside diameter than the circular metal blank in its starting condition. During the first sinking of the pressure roller into the axial surface of the circular metal blank, the latter is pressed on its outer circumference against the inner circumference of the abutment chuck and is held there in a secure manner. Then the pressure roller is moved axially toward the interior so that, in the manner of German Patent Document DE 4400257C1, a hub forms around a center mandrel.

Based on this state of the art, the present disclosure provides a method by which flatter hubs, or flanges, are produced in a non-cutting manner on circular metal blanks. In particular, flanges are constructed on the metal roll whose radial ring width is greater than the axial height. In particular, it is within the scope of the present disclosure that the flange is slightly thicker than the starting material.

The present disclosure relates to a method for the production of a flange on a circular metal blank by at least one pressure roller. The method steps include: providing a circular metal blank; providing at least one pressure roller; forming a conically shaped structure on the circular metal blank, the conically shaped structure tapering toward a median perpendicular of the circular metal blank; and, forming a flange on the circular metal blank by a subsequent treatment, the flange being formed from the conical-shaped structure.

Accordingly, a method of constructing a flange on a circular metal blank has at least the following steps:

By a pressure roller, a structure which is conical and tapers toward a mean perpendicular of the circular metal blank, is formed on the circular metal blank, and a flange is formed from the conical structure by a subsequent treatment.

As an alternative, another method for the production of a flange on a circular metal blank may also comprise the following steps:

By at least one rotatable pressure roller, an axial thickness of the circular metal blank is reduced at least in sections along its radial dimension and the material is shaped into a hub-type and/or conical structure, and from the structure which has the shape of a hub and/or is conical toward the mean perpendicular, a flange is formed on the circular metal blank by a subsequent treatment.

It is within the scope of the present disclosure that the axial dimension of the flange is smaller than its radial dimension. However, the flange should be axially thicker than the initial workpiece. The radial dimension of the flange is more than twice, and may be more than three times, as large as its axial dimension, which may be advantageous when implementing or producing starter rims with relatively flat flanges made of thin circular blanks as the initial workpiece.

The circular blanks with flange attachments produced in accordance with the methods of the present disclosure from circular metal blanks, are suitable for the production of engine and transmission parts of all types. Such circular blanks with flange attachments have a flat flange attachment in a median area, particularly around a centric hole extending through the circular blank.

The forming of the conical structure can take place in a simple manner in that an adjustment angle "$\alpha$" of the pressure roller relative to the axial surface of the circular metal blank is greater than 90°. Good results are achieved when the angle of adjustment "$\alpha$" of the pressure roller relative to the axial surface of the circular metal blank is greater than 110° and smaller than 170°, and when the angle "$\alpha$" is greater than 115° and smaller than 150°.

The circular metal blank is held on its outer circumference by an abutment chuck.

In addition, it is advantageous in the case of very thin circular metal blanks, for example, for starter rims for the circular metal blank to be held down on its side facing the pressure roller at least in sections in an outer area by a ring. In this manner, "thin" starter rims for engines can be manufactured, and in which case a rim with an inner flange can be produced from a disk-type circular blank having a thickness of only a few millimeters, for example less then five millimeters. In such a case, the circular blank may be reduced to a thickness of, for example, only 3 mm in a median radial area. Then the resulting inner projection is reshaped without cutting, for example, on a press, to form the flange, and an outer edge can be formed in a manner known in the fashion of a starter rim.

The flange is constructed on the side of a circular metal blank facing away from the pressure roller.

However, it is within the scope of the present disclosure for the flange to be constructed on a side of the circular metal blank facing the pressure roller if the tool has a corresponding recess in the area provided for the flange. Likewise, it is within the scope of the present disclosure for the flange to extend on both axial sides of the circular metal blank.

Another embodiment includes a flange that is pressed into a tool having a contour, which may be a toothing, so that, on its side facing the tool, the flange is provided with a corresponding contour, for example, a toothing.

The present disclosure includes creating a transmission part with a flange, around a centric bore. The flange of the transmission part is produced by one or more of the methods according to the present disclosure. The flange is connected in one piece with the transmission part. The transmission part may be constructed as a starter rim which is produced from a circular blank having a starting width or axial thickness of less than 7 mm, or, for example, less then 5 mm, or, for example, less than 4 mm. The starter rim, in sections, is thinner than an initial width of the circular blank, and the starter rim has a flange toward an inner passage hole. The flange is formed on in one piece by pressing and is more than twice, or more than four times as wide in a radial dimension as it is high in an axial dimension.

In a starter rim according to the known art, the flange was produced from a separate ring which was placed on a circular blank. Such an arrangement can be eliminated, according to the present disclosure. According to the present disclosure, a gear rim is attached or shaped in one piece to the outer circumference of the starter rim. The appearance of the starter rim is basically similar to that as shown in FIG. 4 of the present disclosure. However, the proportions may be different because the flange is only slightly higher than the initial circular blank, as shown in FIG. 5 of the present disclosure.

Other aspects of the present disclosure will become apparent from the following descriptions when considered in conjunction with the accompanying drawings.

BRIEF DESCRIPTION OF THE DRAWINGS

FIG. 1 is an illustrated embodiment of a disk-shaped circular metal blank 1 which is penetrated by a centric bore 2. In a manner similar to a placing of blank 12 in tool 11, as shown in FIG. 5, circular metal blank 1 may be placed in a tool 11 which tool 11 rotates about the axis S during a machining of circular metal blank 1.

Figure 4:
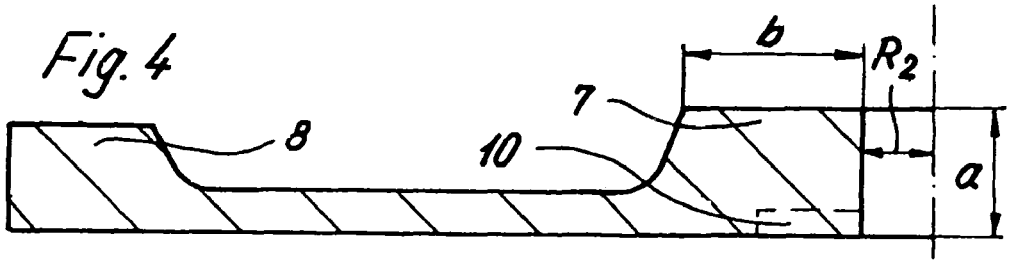
FIG. 4 is a view of the circular metal blank of FIG. 1 having a non-cutting-produced flange section.

An axial thickness of the circular metal blank 1 in a starting condition is marked with the reference symbol "d". A radius of the centric bore or passage hole 2 before the machining is marked with the reference symbol $R_1$. After the machining the radius of the centric bore 2 is marked with the reference symbol $R_2$. An axial dimension, or height, of a flange 7, as shown in FIG. 4, after the machining, is marked with reference symbol "a" and a radial dimension, or width, is marked with reference symbol "b".

As a starting workpiece, the circular metal blank 1 is placed in a tool 11 and is held on an outer circumference by an abutment chuck in a manner of German Patent Document DE 44 44 536 C1. Centric bore 2 may be penetrated by a conically shaped centric mandrel (not shown).

Machining at first may follow the method described in German Patent Document DE 44 00 257 C1 or DE 44 44 536 C1. That is, at least one rotatable pressure roller 3 rotating relative to the circular sheet metal blank 1, sinks at first axially from an outside into an axial side of the circular metal blank 1 rotating with the tool 11, the axial side facing away from the tool 11 (not shown), so that, when a ring-type abutment chuck is used, circular metal blank 1 is at first form-lockingly placed on an inner circumference of the abutment chuck.

As a result of a simultaneous or subsequent movement of the pressure roller 3, which rotates relative to the circular sheet metal blank 1, radially toward an interior, that is, toward the bore 2, a hub-type or hub-like conically tapering structure 4 is formed on the inner circumference of the circular metal blank 1 or on the bore 2. Tapering structure 4 on the inner circumference of the circular metal blank 1 projects in a conical shape radially to the outside because an angle of adjustment $\alpha$ on an advancing flank 9 of the pressure roller 3 relative to a surface of the circular metal blank 1, is negative or greater than 90°. The angle of adjustment may be between 110° and 170°, and may be between 115° and 140°.

Tapering conical structure 4 is then subjected to a subsequent treatment to form the flange 7. The axial height "a" of the flange 7 is smaller than radial dimension "b".

The subsequent treatment takes place by another pressure roller which is constructed as a rotatable pressure or adjustment roller 5 which is guided radially from an outside to an inside or, by an additional pressure roller 6, which is guided axially from the outside to the inside. The subsequent treatment takes place such that, directly in a next operating step, the shape of flange 7 is formed from the tapering conical structure 4 which may be around a centric mandrel. An adjustment angle of the additional rotatable pressure roller 6 is at approximately 90°.

Figure 5:
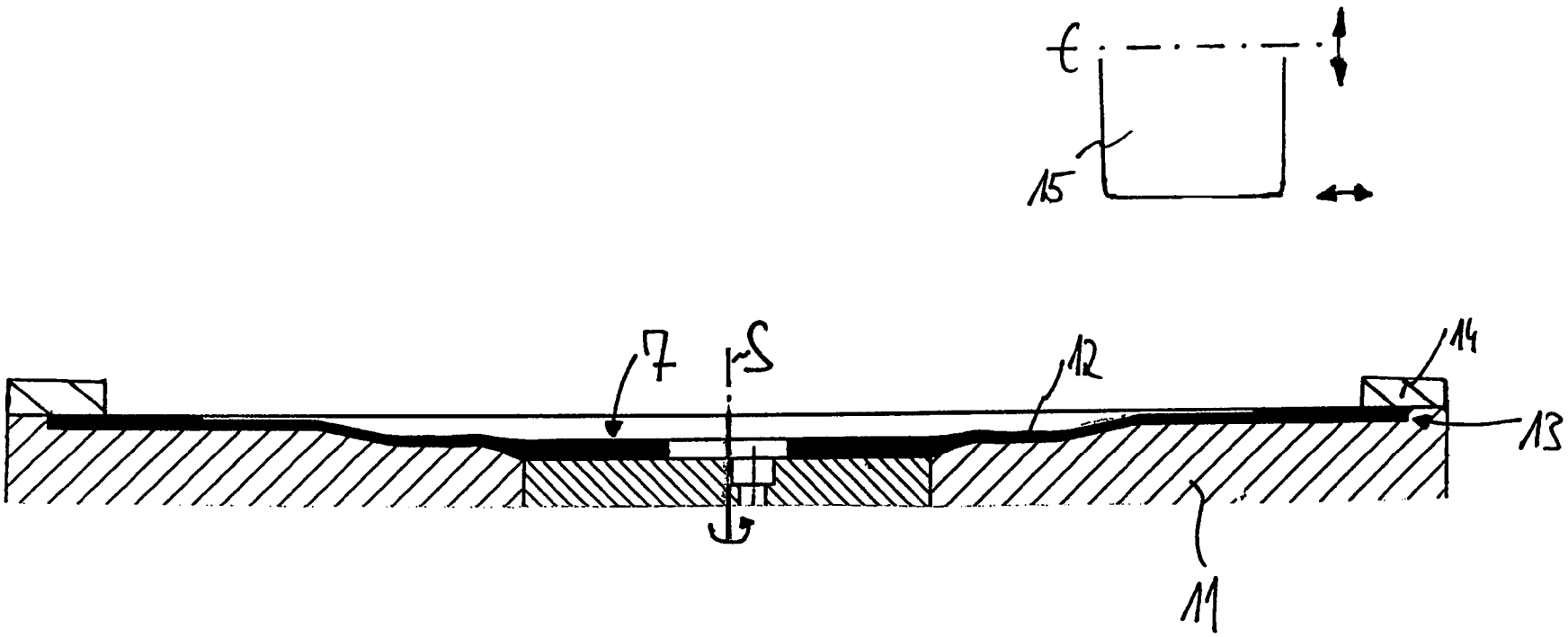
FIG. 5 is a view of a blank machined according to a method of the present disclosure for producing a starter rim.

It is within the scope of the present disclosure that, when forming the tapering conical structure 4, simultaneously an axially and/or radially applied rotatable hold-down roller 15, as shown, for example, in FIG. 5, of a type similar to the adjustment roller 5, may also be running on a side of circular metal blank 1 situated radially opposite the pressure roller 6. Hold-down roller 15 presses down the circular metal blank 1, at least in sections, so that the circular metal blank 1 does not lift off the tool 11 or arch forward from the tool 11 in an area in which the pressure roller 3 is moving.

As an alternative, a subsequent treatment with other devices is also within the scope of the present disclosure. Such other devices include a press which shapes the flange 7 from a hub-type structure. However, a subsequent treatment in the same chucking arrangement with another forming roller is also possible and may be simple.

Although another operating step is required for forming the flange 7, in contrast to the forming of a hub as mentioned above, such as the subsequent treatment of the tapering conical structure 4, it is possible, by using a forming and non-cutting cold-working pressure forming method, to precisely construct very flat flanges on circular metal blanks whose diameter is smaller than the starting diameter of the circular metal blank 1.

As an alternative, it is also within the present disclosure to carry out a sinking directly from an outer circumference radially into a workpiece. That can be done if, for example, the axial dimension of the abutment chuck is slightly smaller than the thickness of the circular metal blank.

Figure 1:
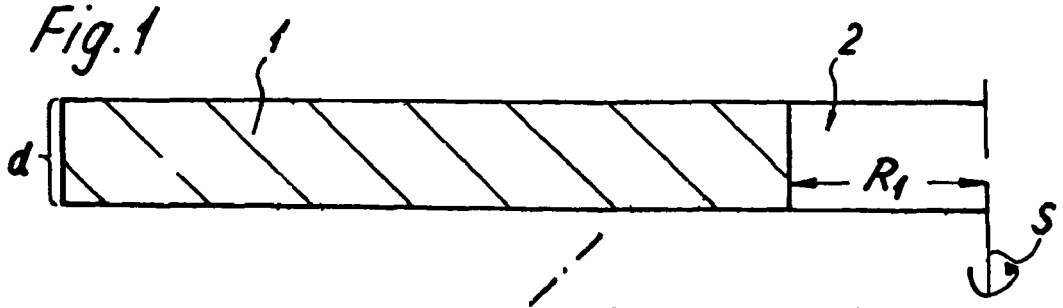
FIG. 1 is a view of a circular metal blank as a starting workpiece before machining, according to the present disclosure.
Figure 2:
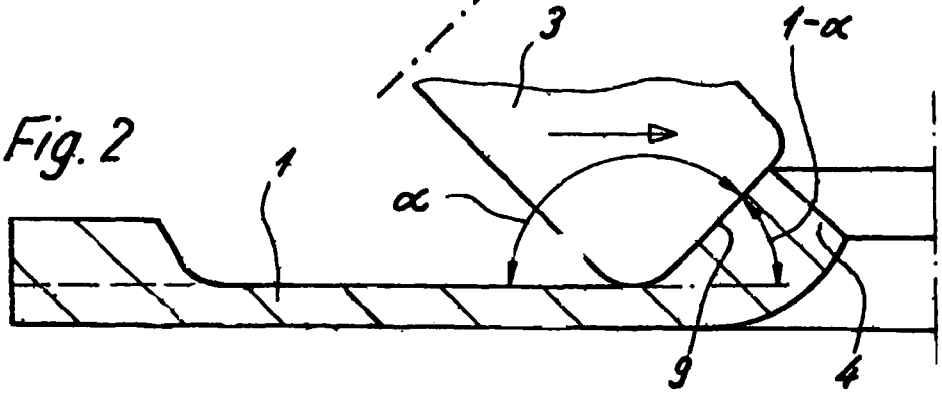
FIG. 2 is a view of the circular metal blank of FIG. 1 during a first machining step.
Figure 3:
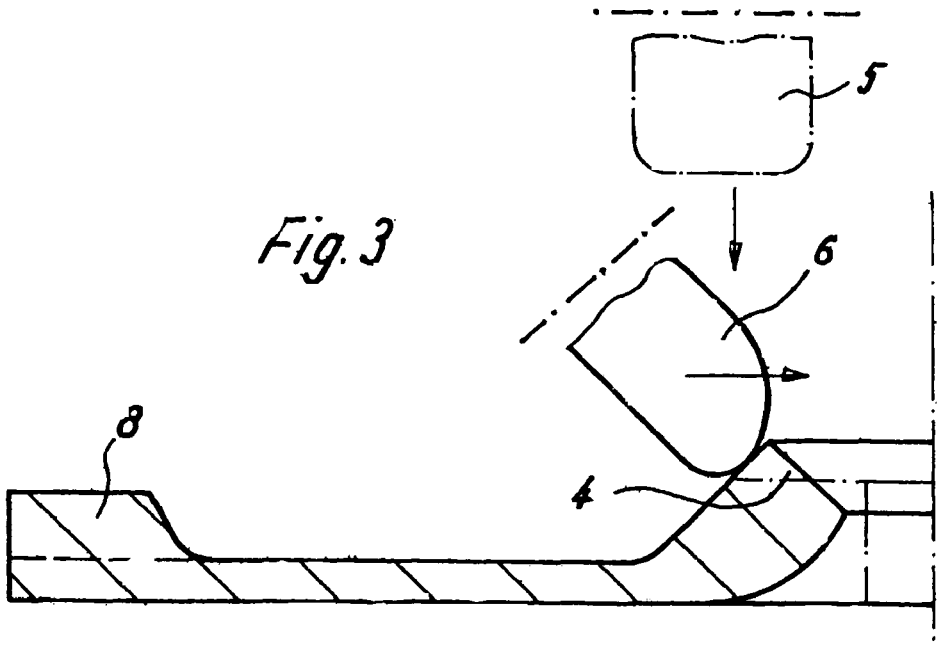
FIG. 3 is a view of the circular metal blank of FIG. 2 during another operating step, in which two different subsequent treatment embodiments are shown for this operating step, as represented by one roller in solid lines and another in dotted lines.

According to FIG. 1, a sinking-in takes place slightly offset from the outer circumference of the circular metal blank 1 and toward the inside. An advantage is achieved such that an area 8 remains on the outer circumference of the circular metal blank 1. Area 8 can be subjected to a subsequent treatment, for example, in order to form a profiling of a pulley or a toothing of a starter rim (not shown).

A contour, such as a toothing, can be formed in the tool 11, or in a first or second additional tool, so that the flange 7 is provided with a corresponding contour, such as a toothing 10 during the pressing.

FIG. 5 illustrates a blank 12, machined according to a method of the present disclosure and produced from a flat circular metal blank for producing a starter rim. A tool 11 includes an outer abutment ring section 13, or abutment chuck, a ring 14 placed or pressed on for holding down the relatively thin circular metal blank 12 in an outer area. It is possible to have an additional pressing of the circular metal blank 12 between the outer circumference and the inner flange in sections to be thinner or thicker and/or a pressing of the blank 12 in a direction of the axis S to be conical and/or stepped against a correspondingly constructed bottom die of the tool 11.

One or more of the pressings can occur by the pressure roller 3 or an additional pressure roller or the hold-down roller 15. The flange 7 is pressed from the tapering conical structure 4 into the tool 11 on a side situated opposite the machining by the pressure roller 3.

If a toothing, such as a radial toothing were formed in the side situated opposite the machining by pressure roller 3, a toothing, such as toothing 10, would be formed in the flange 7, as shown in dotted lines in FIG. 5.

Although the present disclosure has been described and illustrated in detail, it is to be clearly understood that this is done by way of illustration and example only and is not to be taken by way of limitation. The scope of the present disclosure is to be limited only by the terms of the appended claims.

The invention claimed is:

1. A method for the production of a flange on a circular metal blank by at least one pressure roller, the method steps comprising:

providing a circular metal blank having a centric bore;

providing at least one pressure roller;

forming a conically shaped structure on the circular metal blank, the conically shaped structure tapering toward a median perpendicular adjacent the centric bore of the circular metal blank; and forming a flange on the circular metal blank by a subsequent treatment, the flange being formed adjacent the centric bore from the conically-shaped structure, and an axial dimension of the flange is smaller than a radial dimension of the flange.

2. The method according to claim 1, wherein a radial dimension of the flange is more than twice as large as an axial dimension of the flange.

3. The method according to claim 1, wherein during the forming of the conically-shaped structure, the at least one pressure roller is sunk first into the circular metal blank and is then radially moved from an outside toward an inside of the circular metal blank.

4. The method according to claim 1, wherein an adjustment angle of the at least one pressure roller relative to an axial surface of the circular metal blank is greater than 90°.

5. The method according to claim 1, wherein an adjustment angle of the at least one pressure roller relative to an axial surface of the circular metal blank is greater than 110° and smaller than 170°.

6. The method according to claim 1, wherein an adjustment angle of the at least one pressure roller relative to an axial surface of the circular metal blank is greater 115° and smaller than 150°.

7. The method according to claim 1, wherein during the forming of the conically-shaped structure, simultaneously one of an axially and radially adjustable hold-down roller runs on a side of the circular metal blank situated radially opposite the pressure roller and presses the circular metal blank down, at least in sections, such that the circular metal blank does not lift off a tool or arch forward in an area in which the pressure roller is moving.

8. The method according to claim 1, wherein the subsequent treatment includes an additional pressure roller.

9. The method according to claim 8, wherein the additional pressure roller is a rotatable pressure roller that sinks axially into the conically-shaped structure during the subsequent treatment.

10. The method according to claim 8, wherein the additional pressure roller sinks radially into the conically-shaped structure during the subsequent treatment.

11. The method according to claim 1, wherein the subsequent treatment takes place by a press.

12. The method according to claim 1, wherein an inside diameter of the circular metal blank including the formed flange is smaller than an inside diameter of the centric bore of the circular metal blank.

13. The method according to claim 1, wherein during the forming of the conically-shaped structure, the circular metal blank is penetrated by a conically tapering mandrel.

14. The method according to claim 1, wherein the circular metal blank is held by an abutment chuck on an outer circumference of the circular metal blank.

15. The method according to claim 1, wherein the circular metal blank is held down on a side facing the at least one pressure roller by a ring.

16. The method according to claim 1, wherein the circular metal blank is held down on a side facing the at least one pressure roller, at least in sections, by a hold-down roller.

17. The method according to claim 1, wherein the flange is constructed on a side of the circular metal blank facing away from the at least one pressure roller.

18. The method according to claim 1, wherein the flange is formed on a side of the circular metal blank facing the at least one pressure roller.

19. The method according to claim 1, wherein the flange extends on both axial sides of the circular metal blank.

20. The method according to claim 1, wherein the flange is pressed into a tool having a toothing contour, so that, on a side of the flange facing the tool, the flange includes a corresponding toothing contour.

21. The method according to claim 20, wherein the tool rotates during a machining of the circular metal blank.

22. The method according to claim 1, wherein the at least one pressure roller is disposed in a rotatable manner.

23. A transmission part having an integral flange around a the centric bore, the flange produced according to the method of claim 1.

24. The transmission part according to claim 23, wherein the transmission part is formed as a starter rim from the circular metal blank, the circular metal blank having an initial width of less than 7 mm, the starter rim, in sections, being thinner than the initial width of the circular metal blank, and the flange being located toward an inner passage hole and formed in one piece by a pressing.

25. The method according to claim 7, wherein the hold-down roller is disposed in a rotatable manner.

26. A method for the production of a flange on a circular metal blank by at least one pressure roller, the method steps comprising:

providing a circular metal blank having a centric bore and an axial thickness;

providing at least one pressure roller;

reducing, at least in sections, the axial thickness along a radial dimension of the circular metal blank and shaping material of the circular metal blank into one of a hub and a conical structure; and forming a flange on the circular metal blank adjacent the centric bore by a subsequent treatment of the hub or the conical structure such that an axial extension of the flange is only slightly larger than the axial thickness of the circular metal blank.

27. A transmission part having an integral flange around the centric bore, the flange produced according to the method of claim 26.

28. The transmission part of claim 27, wherein the transmission part is formed as a starter rim from a circular metal blank having an initial width less than 7 mm, the starter rim, in sections, being thinner than the initial width of the circular metal blank, and the flange being located toward the centric bore and formed in one piece by a pressing.

29. A method for the production of a flange on a circular metal blank by at least one pressure roller, the method steps comprising:

providing a circular metal blank having a centric bore;

providing at least one pressure roller;

forming a conically shaped structure on the circular metal blank by moving the at least one pressure roller axially from an outside toward the centric bore, the conically shaped structure tapering toward a median perpendicular of the circular metal blank; and forming a flange on the circular metal blank by a subsequent treatment, the flange being formed from the conically-shaped structure by moving the at least one pressure roller axially from an outside toward the centric bore, and an axial dimension of the flange is smaller than a radial dimension of the flange.

30. A method for the production of a flange on a circular metal blank by at least one pressure roller, the method steps comprising:

providing a circular metal blank having an axial thickness;

providing at least one pressure roller;

reducing, at least in sections, the axial thickness along a radial dimension of the circular metal blank and shaping material of the circular metal blank into one of a hub and a conical structure by moving the at least one pressure roller axially from an outside toward the centric bore; and forming a flange on the circular metal blank by a subsequent treatment of the hub or the conical structure by moving the at least one pressure roller axially from an outside toward the centric bore such that an axial extension of the flange is only slightly larger than the axial thickness of the circular metal blank.

* * * * *